US006827652B1

(12) United States Patent
Castro, Jr.

(10) Patent No.: US 6,827,652 B1
(45) Date of Patent: Dec. 7, 2004

(54) ILLUMINABLE BILLIARD CUE STICK

(76) Inventor: Johnny J Castro, Jr., 101 W. Hackberry, Karnes City, TX (US) 78118

( * ) Notice: Subject to any disclaimer, the term of this patent is extended or adjusted under 35 U.S.C. 154(b) by 0 days.

(21) Appl. No.: 10/679,891

(22) Filed: Oct. 6, 2003

(51) Int. Cl.[7] ..... A63D 15/08
(52) U.S. Cl. ..... 473/44
(58) Field of Search ..... 473/2, 44–51

(56) References Cited

U.S. PATENT DOCUMENTS

| | | | | | |
|---|---|---|---|---|---|
| 5,181,718 | A | * | 1/1993 | Valentine | 473/2 |
| 5,653,640 | A | * | 8/1997 | Shirley, Jr. | 473/2 |
| 6,117,019 | A | * | 9/2000 | Taylor | 473/46 |
| 6,155,929 | A | * | 12/2000 | Chipman | 473/2 |
| 6,165,078 | A | * | 12/2000 | Holt | 473/44 |

FOREIGN PATENT DOCUMENTS

| | | | | |
|---|---|---|---|---|
| GB | 2276825 A | * | 10/1994 | A63D/15/08 |

* cited by examiner

*Primary Examiner*—Mark S. Graham
(74) *Attorney, Agent, or Firm*—Michael I. Kroll

(57) ABSTRACT

The present invention 10 discloses a billiards cue stick having light-generating elements 40 within the body of the cue stick. The multi-sectioned cue stick 20, 22 has a throughbore 36 for receiving a light-generating circuit 38. Positioned behind the tip 34 is a translucent ferrule 26 having a light-generating element 40 in close proximity to the translucent ferrule. When the light-generating element is energized the light rays will cause the translucent ferrule to glow. Also positioned within the body of the cue stick is a power source 30, 32 for energizing the light-generating elements 40. Positioned within the butt of the handle 20 is another translucent element having a light-generating element able to cause the translucent end piece 28 to glow. The fastening mechanism 24 forms the switch of the light circuit wherein when the stick is assembled the light elements are energized.

11 Claims, 12 Drawing Sheets

ILLUMINABLE BILLIARD CUE STICK

BACKGROUND OF THE INVENTION

Field of the Invention

The present invention relates generally to sports equipment and, more specifically, to a billiards cue stick having light generating elements within the body of said cue stick. The preferred embodiment of the present invention provides for a multi-sectioned cue stick having a throughbore for the placement therein of a light generating circuit. Positioned behind the tip of the cue is a translucent ferrule having a light generating element in close proximity to said translucent element so that when the light generating element is energized the light rays will cause the translucent element to glow. Also positioned within the body of the cue stick is a power source for energizing the light generating elements. Positioned within the butt of the handle is another translucent element having a light generating element in close proximity whereby when energized the light element will cause the translucent element to glow. The fastening mechanism of the multi-sectioned cue stick form the switch of the light circuit thereby when the stick is assembled the light elements are energized.

SUMMARY OF THE PRESENT INVENTION

The present invention discloses a billiards cue stick having light-generating elements within the body of the cue stick. The preferred embodiment of the present invention provides for a multi-sectioned cue stick having a throughbore for the placement therein of a light-generating circuit. Positioned behind the tip of the cue is a translucent ferrule having a light-generating element in close proximity to the translucent ferrule so that when the light-generating element is energized the light rays will cause the translucent ferrule to glow. Also positioned within the body of the cue stick is a power source for energizing the light-generating elements. Positioned within the butt of the handle is another translucent element having a light-generating element in close proximity whereby when energized the light element will cause the translucent end piece to glow. The fastening mechanism of the multi-sectioned cue stick forms the switch of the light circuit wherein when the stick is assembled the light elements are energized.

A primary object of the present invention is to provide an illuminated billiards cue stick.

Another object of the present invention is to provide a billiard cue stick having a throughbore for the placement therein of a light generating circuit.

Yet another object of the present invention is to provide a billiards cue with at least one light generating element within the body of said billiards cue stick.

Still yet another object of the present invention is to provide a billiards cue with a power source for energizing said light generating element.

Another object of the present invention is to provide a billiards cue having a translucent ferrule positioned behind the cue tip.

Yet another object of the present invention is to provide a billiards cue having a light generating element wherein said light beams emanate from said translucent ferrule.

Still yet another object of the present invention is to provide a billiards cue having a light generating element within the butt of a billiards cue stick.

Another object of the present invention is to provide a power source for said light generating element with the butt of the cue stick.

Yet another object of the present invention is to provide a multi-sectioned cue stick wherein assembly of said cue stick completes the light generating circuit causing the light generating element to illuminate.

Still yet another object of the present invention is to provide a billiard cue stick having a channel for the placement therein of a light generating circuit.

Additional objects of the present invention will appear as the description proceeds.

The present invention overcomes the shortcomings of the prior art by providing a billiards cue stick having light generating elements within the body. In the preferred embodiment the cue stick is a multi-sectioned cue stick having a throughbore for the placement therein of a light generating circuit. Positioned behind the tip of the cue is a translucent ferrule having a light generating element in close proximity to said translucent element so that when the light generating element is energized the light rays will cause the translucent element to glow. Also positioned within the body of the cue stick is a power source for energizing the light generating elements. Positioned within the butt of the handle is another translucent element having a light generating element in close proximity whereby when energized the light element will cause the translucent element to glow. The fastening mechanism of the multi-sectioned cue stick form the switch of the light circuit thereby when the stick is assembled the light elements are energized.

Additionally, the present invention provides for an additional element wherein the wires are placed within a channel just below the exterior surface within the forearm of the cue stick, while the base contains a separate power supply for lighting the butt ferrule.

The foregoing and other objects and advantages will appear from the description to follow. In the description reference is made to the accompanying drawings, which forms a part hereof, and in which is shown by way if illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
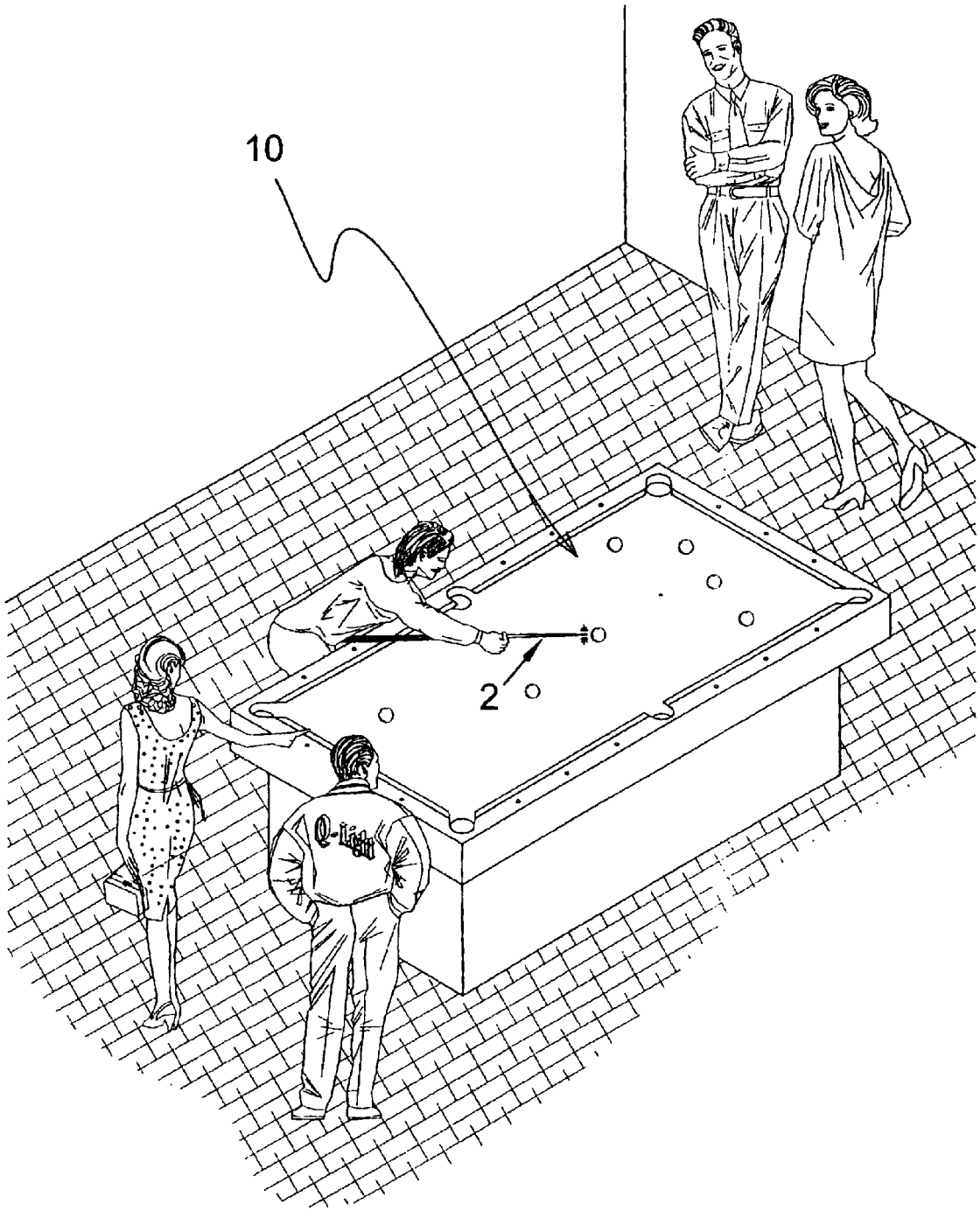
FIG. 1 is an illustrative view of the billiards cue stick of the present invention in use.

With regard to reference numerals used, the following numbering is used throughout the drawings.

10 present invention
12 table
14 balls
16 one piece cue
18 two piece cue
20 handle section
22 forearm
24 fastening means
26 illuminable ferrule
28 illuminable end piece
30 power supply
32 power supply
34 tip
36 throughbore
38 electrical connection
40 light emitting diode
42 nut plate
44 joining screw
46 battery
48 end cap
50 cavity

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the billiards cue stick of the present invention 10 in use. Depicted is the billiards cue stick having illuminable elements positioned at the tip and butt of the billiards cue. The present invention 10 provides means whereby a multi-part pool cue with a throughbore therein has a translucent element positioned behind the tip and includes a bulb wired.to a power source for energizing the bulb for lighting the translucent element.

Figure 2:
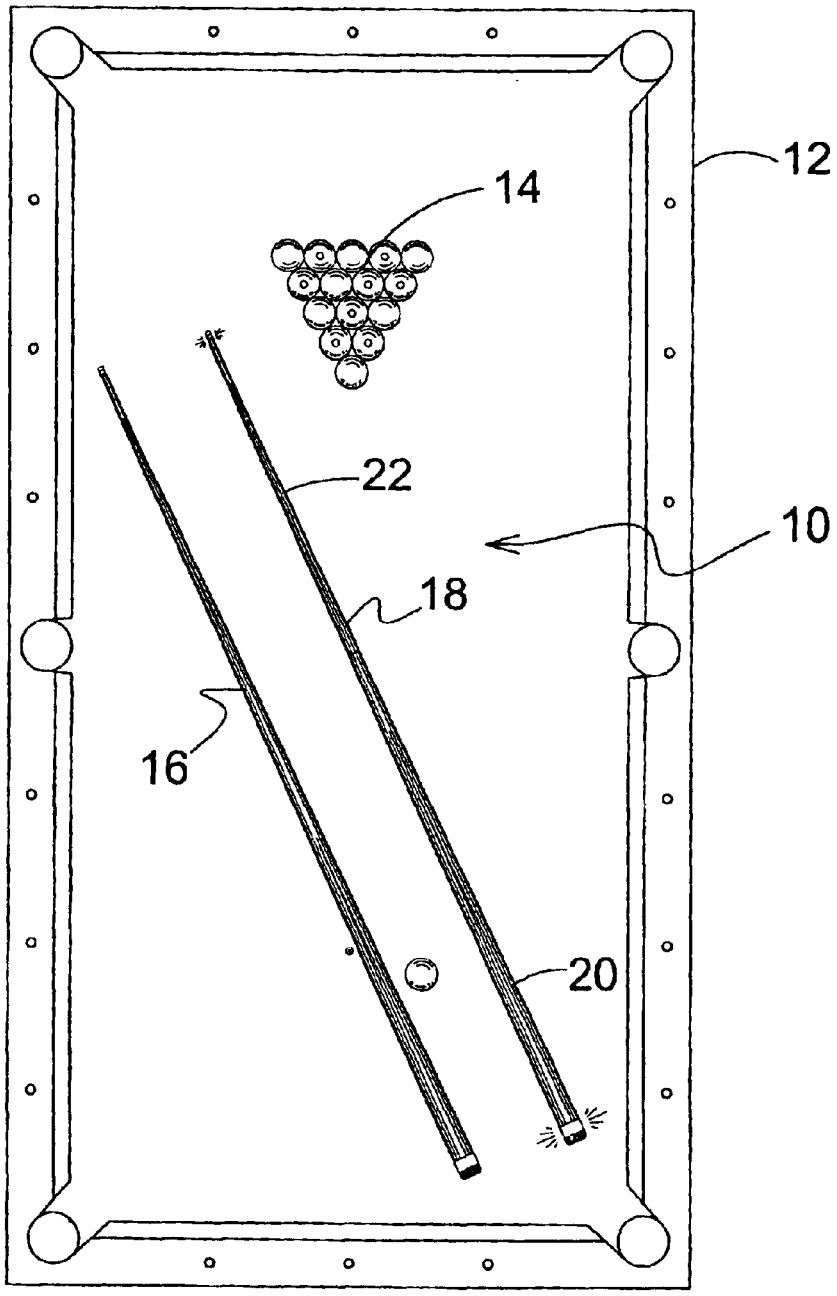
FIG. 2 is an illustrative view of the billiards cue stick of the present invention.

Turning FIG. 2, shown therein is an illustrative view of the billiards cue stick of the present invention 10. Depicted are two billiards cue sticks resting on a billiards table 12 with a rack of billiards balls 14 thereon. Billiards cue stick 16 is a single piece billiards cue while billiards cue stick 18 is a two-piece billiards cue stick comprising a handle 20 and a forearm 22 section. The cue stick 18 has a throughbore within both sections 20, 22 providing means for the placement therein of one or more illuminable elements connected to a power source.

Figure 3:
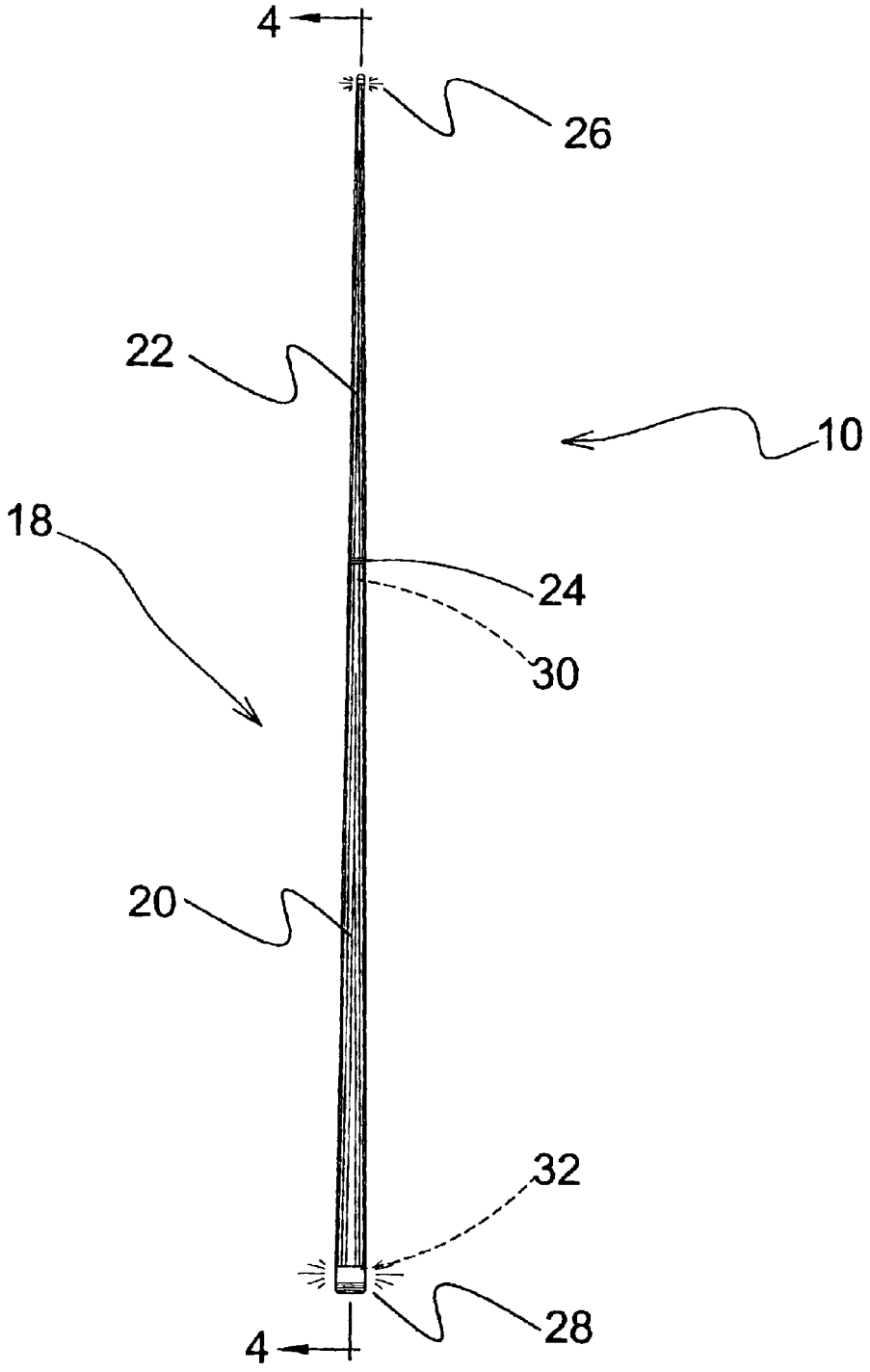
FIG. 3 is a front view of the billiards cue stick of the present invention.

Turning to FIG. 3, shown therein is a front view of the billiards cue stick of the present invention 10. Depicted is the illuminable pool cue of the present invention 10 comprising a multi-part stick 18 having fastening means 24 for connecting the sections 20, 22. Once connected the illuminable elements which include an illuminable ferrule 26 and an illuminable end piece 28 are energized thereby emitting light from the one or more translucent members. The stick 18 has a throughbore whereby the illuminable elements 26, 28 are connected to a first and second power source 30, 32. Fastening the cue sections together at 24 completes the circuit. Unfastening the sections breaks the circuit thereby forming a switch for the illuminable cue stick 18.

Figure 4:
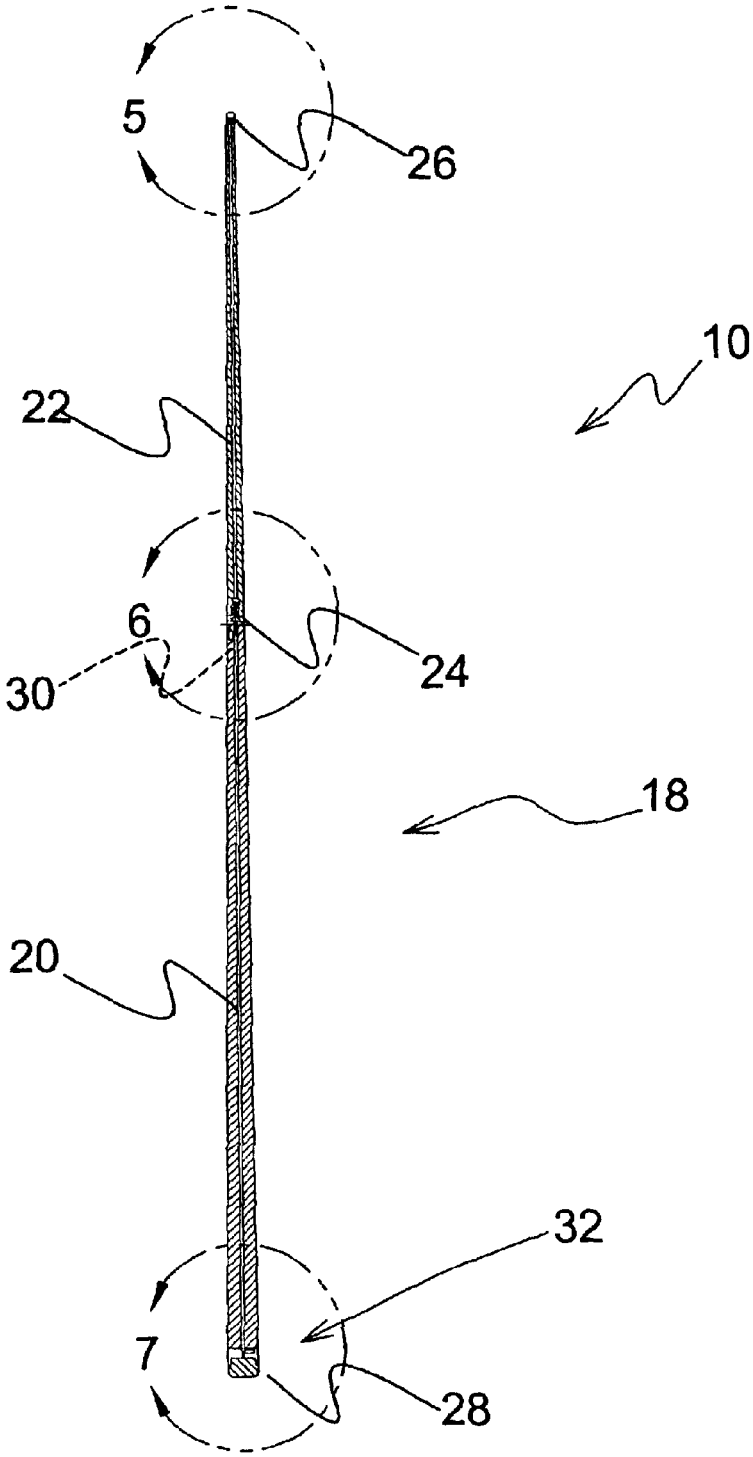
FIG. 4 is a section view of the billiards cue stick of the present invention.

Turning to FIG. 4, shown therein is a section view of the billiards cue stick of,the present invention 10. Shown is a sectional view wherein the cue stick 18 is comprised of section 20, 22. At one distal end is the tip of the cue stick having a translucent element 26 with an illuminable object connected to a power source 30. The illumination occurs when the sections of the cue stick are joined at 24. Another illuminable object and translucent element can be connected at the other distal end 28 to another power source 32 for illuminating the butt of the cue stick 18.

Figure 5:
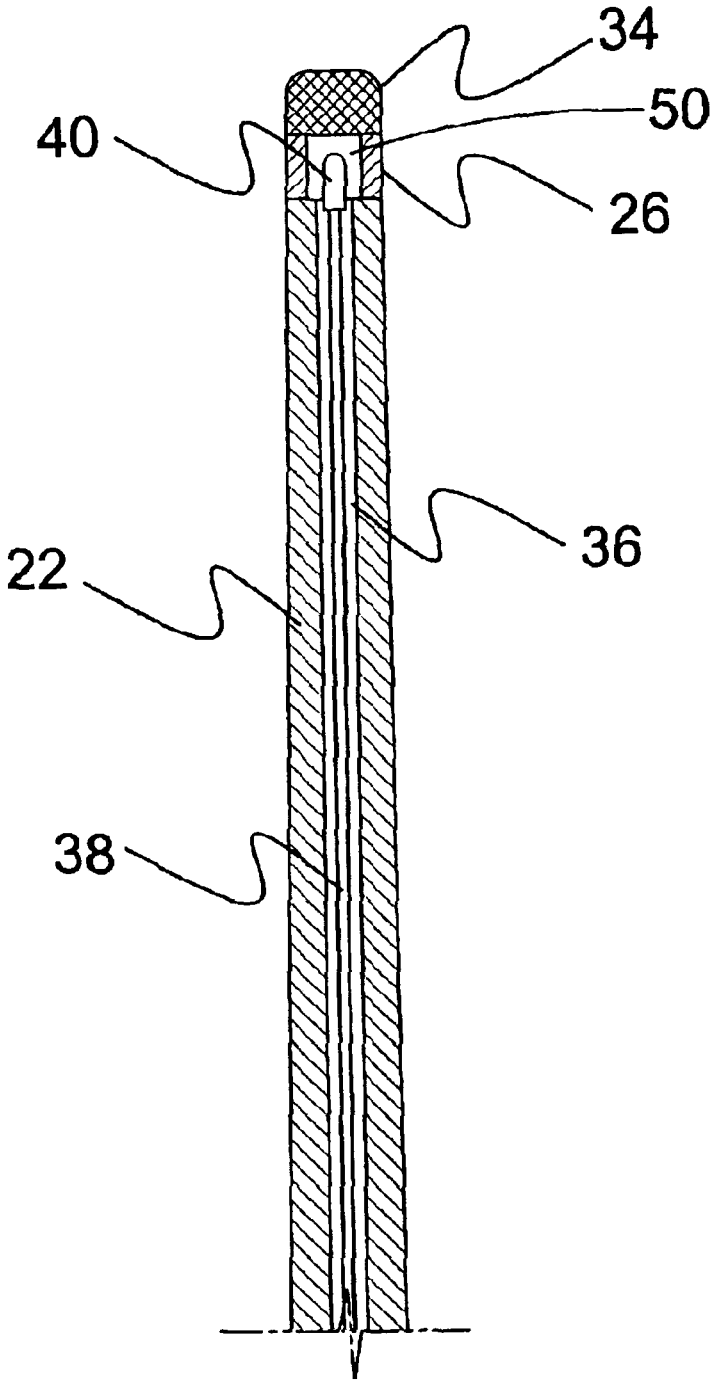
FIG. 5 is an enlarged sectional view of the billiards cue stick tip of the present invention.

Turning to FIG. 5, shown therein is an enlarged sectional view of the billiards cue stick tip of the present invention 10. Shown is an enlarged sectional view taken from FIG. 4 as indicated. Shown is the tip 34 of the stick forearm 22 having a conical cylindrical shape with a cavity 50 therein having a throughbore 36 within a translucent ferrule 26 and whereby the electrical connection 38 from the illuminable element 40 being an LED or the like and the battery is made. The illuminable element 40 in cavity 50 is substantially encompassed by the translucent ferrule 26 and capped by the stick tip 34 wherein energized light rays cause the translucent ferrule 36 to glow.

Figure 6:
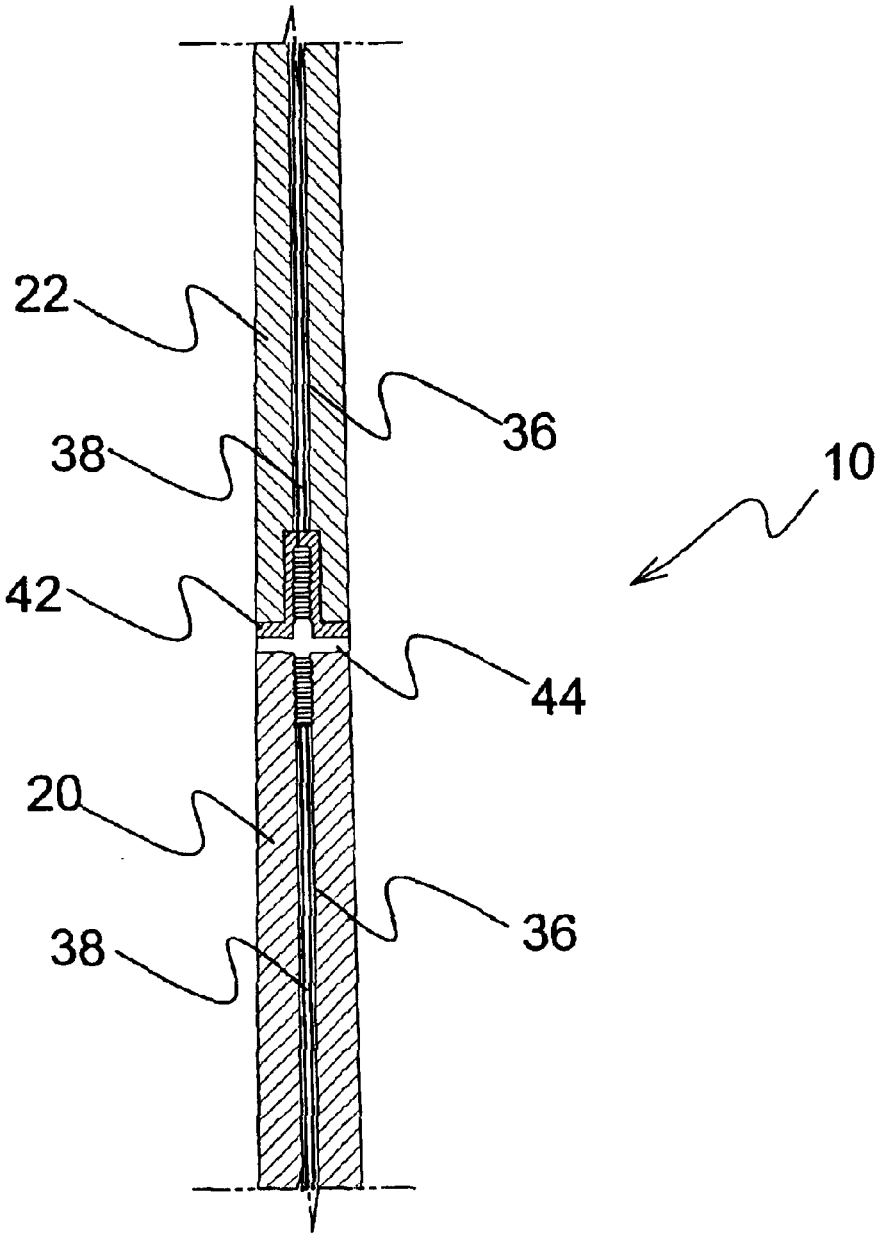
FIG. 6 is a detail section al view of the billiards cue stick of the present invention.

Turning to FIG. 6, shown therein is a detail sectional view of the billiards cue stick of the present invention 10. Depicted is a detail view of one possible fastening means of the billiards cue stick taken from FIG. 4 as indicated showing the throughbore 36 and wire leads 38. Depicted is the present invention 10 being an illuminated billiards cue stick having an illuminable device, such as an LED or chip lights positioned within the body of the stick in electrical communication with a power source. For illustrative purposes a threaded fastener with a nut plate 42 and joining screw 44 is shown as means for connecting a multi-part 20, 22 stick but is not limited exclusively to such a fastening means.

Figure 7:
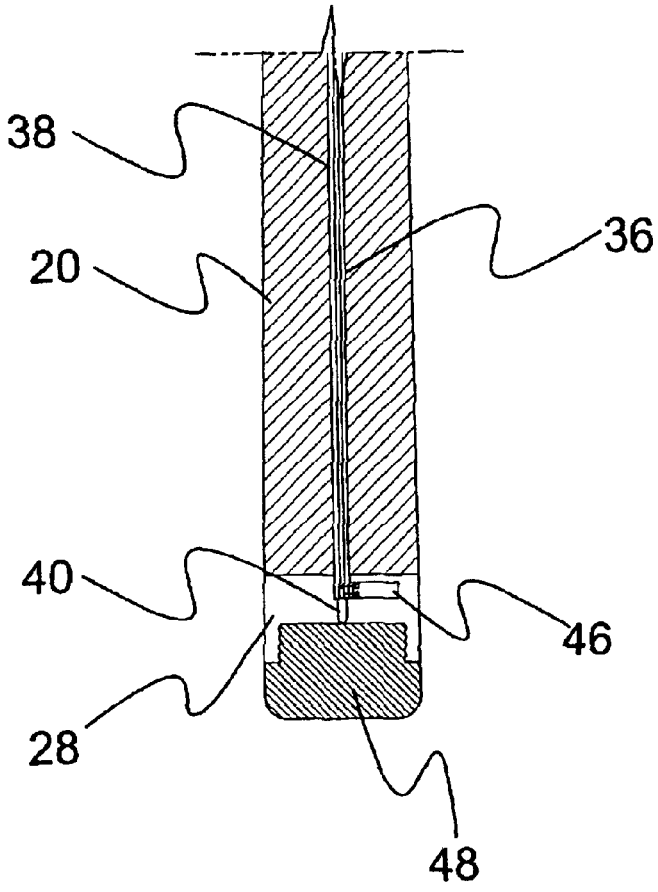
FIG. 7 is an enlarged sectional view of the handle of the cue stick of the present invention.

Turning to FIG. 7, shown therein is an enlarged sectional view of the handle 20 of the cue stick of the present invention. Shown is an enlarged sectional view taken from FIG. 4 as indicated. Shown is the handle 20 of the cue stick having a conical cylindrical shape having a throughbore 36 therein whereby the electrical connection 38 from the illuminable element 40 and the battery 46 is made. The illuminable element 40 is substantially encompassed by a translucent end piece 28 and when energized light rays cause the translucent end piece to glow. Also shown is an end cap 48.

Figure 8:
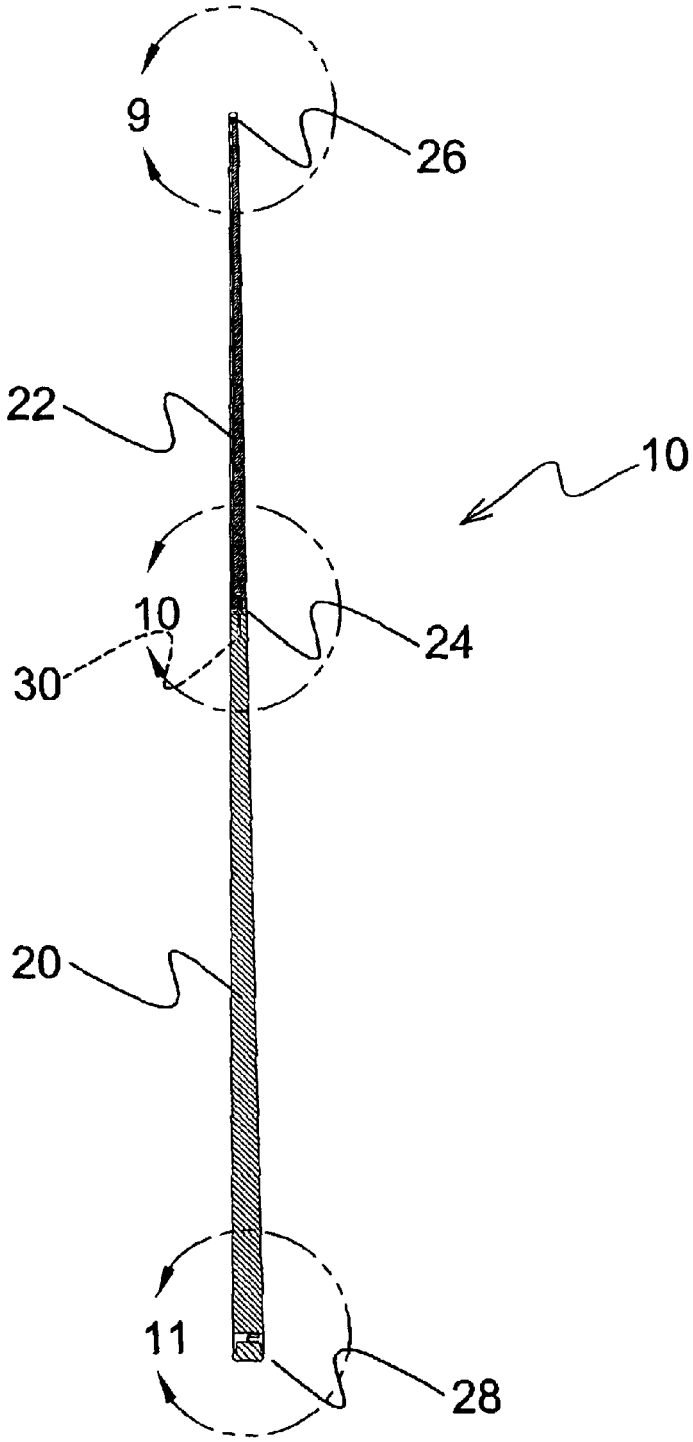
FIG. 8 is an end view of handle side of the billiards cue stick of the present invention with end cap removed.

Turning to FIG. 8, shown therein is a section view of the billiards cue stick of the present invention 10. Shown is a sectional view wherein the cue stick is comprised of sections 20, 22. At one distal end is the tip of the cue stick having a translucent ferrule 26 with an illuminable element connected to a power source 30. The illumination occurs when the sections of the cue stick are joined at 24. Another illuminable end piece 28 and translucent element can be connected at the other distal end to another power source for illuminating the butt of the cue stick.

Figure 9:
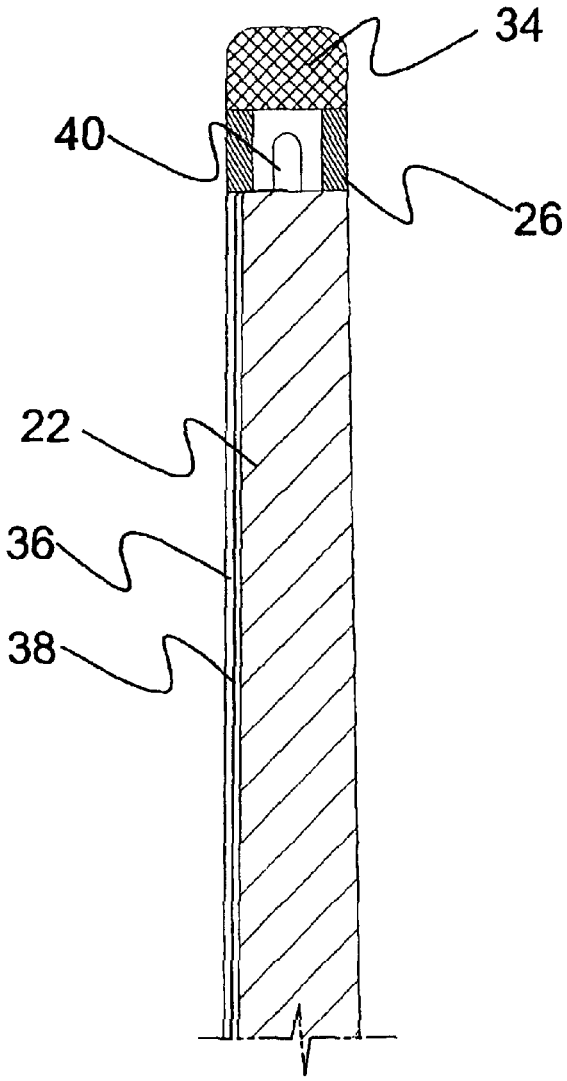
FIG. 9 is an enlarged sectional view of the billiards cue stick tip of the present invention.

Turning to FIG. 9, shown therein is an enlarged sectional view of the billiards cue stick tip of the present invention. Shown is an enlarged sectional view taken from FIG. 8 as indicated. Shown is the tip 34 of the stick forearm 22 having a conical cylindrical shape having a channel 36 therein whereby the electrical connection from the illuminable element 40 and the battery is made. The illuminable element 40 is substantially encompassed by a translucent ferrule 26 and capped by the stick tip. When energized light rays cause the translucent ferrule to glow. Wire lead 38 is also shown.

Figure 10:
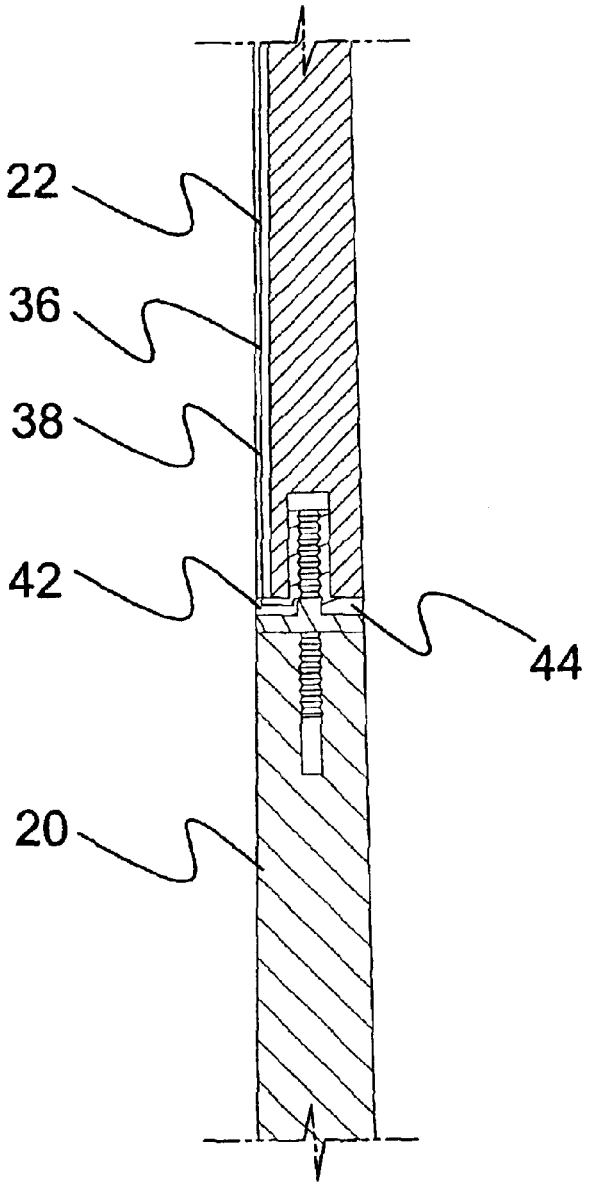
FIG. 10 is a detail sectional view of the billiards cue stick of the present invention.

Turning to FIG. 10, shown therein is a detail sectional view of the billiards cue stick of the present invention. Depicted is a detail view of one possible fastening means of the forearm 22 and handle 20 of the billiards cue stick taken from FIG. 8 as indicated. Depicted is the present invention being an illuminated billiards cue stick having an illuminable device, such as an led or chip lights positioned within the body of the stick in electrical communication with a power source. For illustrative purposes a threaded fastener 42, 44 is shown as means for connecting a multi-part stick but is not limited exclusively to such a fastening means. Also shown are channel 36 and wire leads 38.

Figure 11:
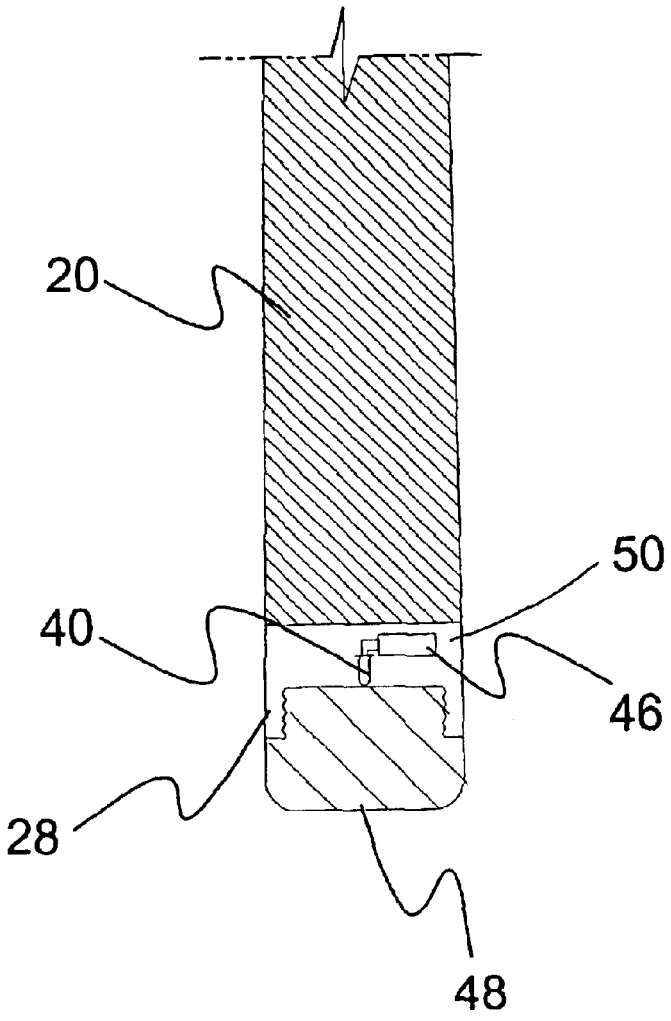
FIG. 11 is an enlarge sectional view of the handle of the cue stick of the present invention.

Turning to FIG. 11, shown therein is an enlarged sectional view of the handle 20 of the cue stick of the present invention. Shown is an enlarged sectional view taken from FIG. 8 as indicated. Shown is the handle 20 of the cue stick having a conical cylindrical shape having a cavity 50 therein whereby the electrical connection from the illuminable element 40 and the battery 46 is made. The illuminable element 40 is substantially encompassed by a translucent end piece 28 and when energized light rays cause the translucent ferrule to glow. End cap 48 is also shown.

Figure 12:
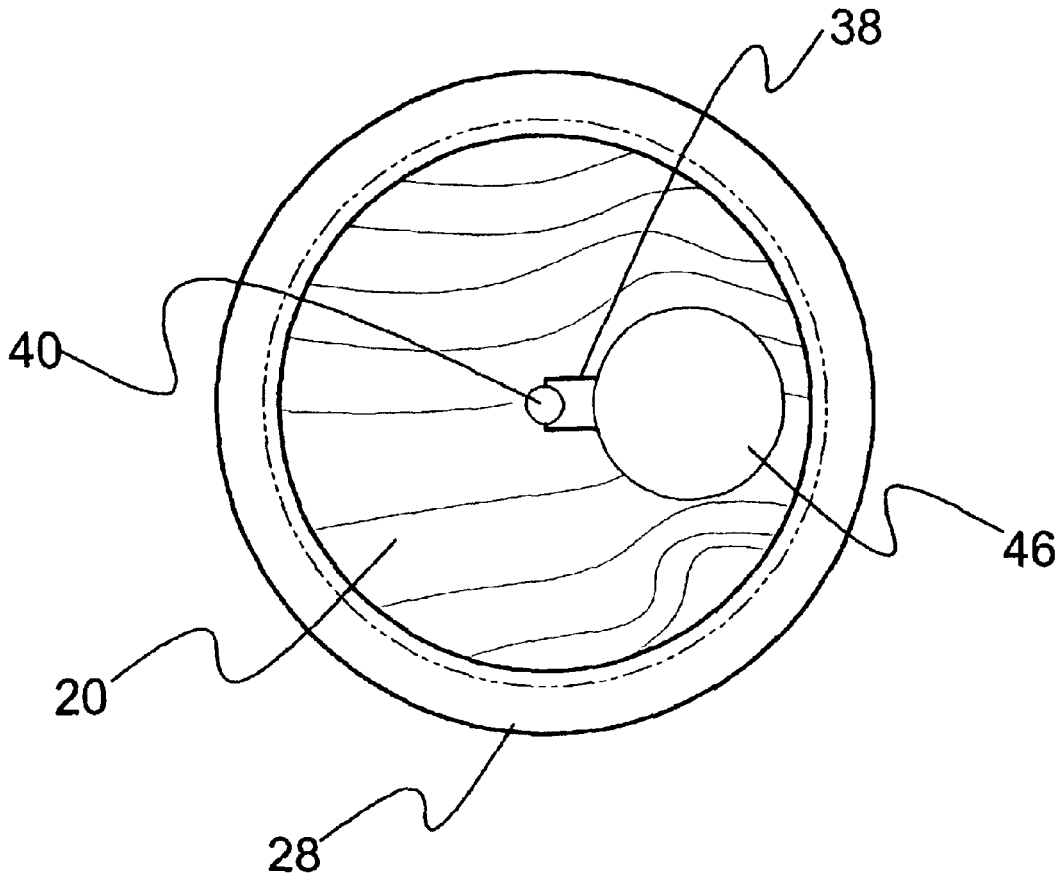
FIG. 12 is an end view of handle section of the billiards cue stick of the present invention with end cap removed.

Turning to FIG. 12,own therein is an end view of handle 20 section of the billiards cue stick of the present invention with end cap removed. Shown are the wire leads 38 from the battery 46 resting within the handle and connecting to poles of the LED 40. Also shown is a translucent cylinder shaped end piece 28 or housing wherein the LED and battery are disposed at the distal end of the billiards cue stick handle 20.

What is claimed to be new and desired to be protected by Letters Patent is set forth in the appended claims.

I claim:

1. An illuminable billiards stick, comprising:

a) a cue stick having a forearm part and a handle part, said forearm part having first and second opposing ends wherein said first end has a cue tip thereon, said handle part having first and second opposing ends wherein said second end has a butt end thereon, said cue stick having a longitudinally disposed throughbore therein, wherein said first end of said forearm part has a first cavity therein, and said butt end has a second cavity therein;

b) a first illuminable element disposed on said first end of said forearm part;

c) a second illuminable element disposed on said second end of said handle part;

d) means for receiving and applying a potential to said first and second illuminable element whereby the first and second illuminable element can be powered;

e) means for fastening said second end of said forearm part to said first end of said handle whereby the forearm and handle are removably fastened together and an electrical switch is provided for the first and second illuminable elements; and, f) means for electrical interconnection of said first and second illuminable element, said means for receiving and applying a potential and said means for fastening whereby electrical current can flow.

2. The billiards stick of claim 1, wherein said first illuminable element further comprises:

a) a first light disposed in said first cavity of said forearm; and, b) a translucent ferrule surrounding said first cavity to permit light rays from the first light to pass therethrough.

3. The billiards stick of claim 2, wherein said first light comprises a first light-emitting diode.

4. The billiards stick of claim 3, wherein said second illuminable element further comprises:

a) a second light disposed in said second cavity of said handle; and, b) a translucent end piece surrounding said second cavity to permit light rays from the second light to pass therethrough.

5. The billiards stick of claim 4, wherein said second light comprises a second light-emitting diode.

6. The billiards stick of claim 5, wherein said means for receiving and applying a potential to said first and second illuminable elements comprises a power supply.

7. The billiards stick of claim 6, wherein said power supply comprises a battery.

8. The billiards stick of claim 7, wherein said power supply comprises a first battery disposed in said first cavity and a second battery disposed in said second cavity.

9. The billiards stick of claim 8, wherein said means for fastening comprises:

a) a nut plate being disposed on said second end of said forearm having a female threaded receptacle therein;

b) a joining screw being disposed on said first end of said handle having a male threaded member thereon, wherein said male threaded member mates with said female threaded receptacle to removably fix the forearm onto the handle of the cue stick; and, c) wherein said nut plate and said joining screw are made of electrically conducting material so that an electrical current can pass through said nut plate and said joining screw when they are fastened together.

10. The billiards stick of claim 9, wherein said means for electrical interconnection comprises:

a) electrical wire connecting said second battery, said second light, said joining screw, said nut plate and said first light; and, b) wherein said electrical wire is disposed in said throughbore of said cue stick.

11. The billiards stick of claim 10, wherein said means for electrical interconnection comprises:

a) electrical wire connecting said first battery, said first light, said nut plate, said joining screw, and said second light; and, b) wherein said electrical wire is disposed in said throughbore of said cue stick.

* * * * *